US009681246B2

(12) United States Patent
Horbach

(10) Patent No.: US 9,681,246 B2
(45) Date of Patent: Jun. 13, 2017

(54) BIONIC HEARING HEADSET

(71) Applicant: Harman International Industries, Incorporated, Stamford, CT (US)

(72) Inventor: Ulrich Horbach, Canyon Country, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 254 days.

(21) Appl. No.: 14/193,402

(22) Filed: Feb. 28, 2014

(65) Prior Publication Data

US 2015/0249898 A1 Sep. 3, 2015

(51) Int. Cl.

| | |
|---|---|
| ***H04R 5/00*** | (2006.01) |
| ***H04S 1/00*** | (2006.01) |
| ***H04R 1/10*** | (2006.01) |
| ***H04R 3/00*** | (2006.01) |
| ***H04R 5/033*** | (2006.01) |
| *H04S 3/00* | (2006.01) |
| *H04S 7/00* | (2006.01) |

(52) U.S. Cl.

CPC ..... *H04S 1/005* (2013.01); *H04R 1/1008* (2013.01); *H04R 3/005* (2013.01); *H04R 5/033* (2013.01); *H04R 2201/401* (2013.01); *H04R 2460/01* (2013.01); *H04S 3/004* (2013.01); *H04S 7/304* (2013.01); *H04S 2420/01* (2013.01)

(58) Field of Classification Search

CPC ..... H04S 1/005; H04S 2420/01; H04S 7/304; H04R 5/033; H04R 3/005; H04R 2460/01; H04R 1/1008; H04R 1/1083; H04R 5/00

USPC ... 381/309, 17, 310, 94.2, 57, 74, 123, 71.8, 381/56, 58, 313, 71.4, 30; 455/550.1; 700/94

See application file for complete search history.

(56) References Cited

U.S. PATENT DOCUMENTS

| | | | | |
|---|---|---|---|---|
| 2002/0041695 | A1* | 4/2002 | Luo | H04R 3/005 381/313 |
| 2004/0076301 | A1* | 4/2004 | Algazi | H04S 7/304 381/17 |
| 2008/0152167 | A1 | 6/2008 | Taenzer | |
| 2012/0020485 | A1* | 1/2012 | Visser | H04R 3/005 381/57 |
| 2013/0243200 | A1 | 9/2013 | Horbach | |

OTHER PUBLICATIONS

Extended European Search Report for European Application No. 15153996.2 dated Apr. 30, 2015.

* cited by examiner

*Primary Examiner* — Vivian Chin
*Assistant Examiner* — Ubachukwu Odunukwe
(74) *Attorney, Agent, or Firm* — Brooks Kushman P.C.

(57) ABSTRACT

A bionic hearing headset for enhancing directional sound from an external audio source. The headset includes a pair of headphones, each having a microphone array that connects listeners to the environment through a plurality of microphones, even while listening to content presented over the headphones from an electronic audio source. The microphone array signals are first converted into beam-formed directional signals. Diffuse signal components may be suppressed using a common, noise-reduction mask. The audio signals may then be converted to binaural format using a plurality of head-related transfer function (HRTF) pairs.

20 Claims, 5 Drawing Sheets

BIONIC HEARING HEADSET

TECHNICAL FIELD

The present application relates to a bionic hearing headset that enhances directional sounds of external sources, while suppressing diffuse sounds.

BACKGROUND

Bionic hearing refers to electronic devices designed to enhance the perception of music and speech. Common bionic hearing devices include cochlear implants, hearing aids, and other devices that provide a sense of sound to hearing-impaired individuals. Many headphones these days include noise-cancelling features that block or suppress external noises that are disruptive to a user's concentration or ability to listen to audio played from an electronic device connected to the headphones. These noise-cancelling features typically suppress all external sounds, including both diffuse and directional sounds, effectively rendering a headphones wearer hearing-impaired as well.

SUMMARY

One or more embodiments of the present disclosure relate to a headset comprising a pair of headphones including a left headphone having a left speaker and a right headphone having a right speaker. The pair of microphone arrays may include a left microphone array integrated with the left headphone and a right microphone array integrated with the right headphone. Each of the pair of microphone arrays may include at least a front microphone and a rear microphone for receiving external audio from an external source. The headset may further include a digital signal processor configured to receive left and right microphone array signals associated with the external audio. The digital signal processor may be further configured to: generate a pair of directional signals from each of the left and right microphone array signals; suppress diffuse sounds from the pairs of directional signals; apply parametric models of head-related transfer function (HRTF) pairs to each pair of directional signals; and add HTRF output signals from each pair of HRTF pairs to generate a left headphone output signal and a right headphone output signal.

The pair of headphones may playback audio content from an electronic audio source. Each pair of directional signals may include front and rear pointing beam signals. The digital signal processor may apply noise reduction to the pairs of directional signals using a common mask to suppress uncorrelated signal components The left microphone array signals may include at least a left front microphone signal vector and a left rear microphone signal vector. Moreover, the digital signal processor may compute a left cardioid signal pair from the left front and rear microphone signal vectors. Further, the digital signal processor may compute real-valued time-dependent and frequency-dependent masks based on the left cardioid signal pair and the left microphone array signals and multiply the time-dependent and frequency-dependent masks by the respective left front and rear microphone signal vectors to obtain left front and rear pointing beam signals.

The right microphone array signals include at least a right front microphone signal vector and a right rear microphone signal vector. Moreover, the digital signal may compute a right cardioid signal pair from the right front and rear microphone signal vectors. Further, the digital signal processor may compute real-valued time-dependent and frequency-dependent masks based on the right cardioid signal pair and the right microphone array signals and multiply the time-dependent and frequency-dependent masks by the respective right front and rear microphone signal vectors to obtain right front and rear pointing beam signals.

One or more additional embodiments of the present disclosure relate to a method for enhancing directional sound from an audio source external to a headset. The headset may include a left headphone having a left microphone array and a right headphone having a right microphone array. The method may include receiving a pair of microphone array signals corresponding to the external audio source. The pair of microphone array signals may include a left microphone array signal and a right microphone array signal. The method may also include generating a pair of directional signals from each of the pair of microphone array signals and suppressing diffuse signal components from the pairs of directional signals. The method may further include applying parametric models of head-related transfer function (HRTF) pairs to each pair of directional signals and adding HTRF output signals from each pair of HRTF pairs to generate a left headphone output signal and a right headphone output signal.

Suppressing diffuse signal components from the pairs of directional signals may include applying noise reduction to the pairs of directional signals using a common mask to suppress uncorrelated signal components.

The left microphone array signals may include at least a left front microphone signal vector and a left rear microphone signal vector. Generating the pair of directional signals from the left microphone array signals may include computing a left cardioid signal pair from the left front and rear microphone signal vectors. It may further include computing real-valued time-dependent and frequency-dependent masks based on the left cardioid signal pair and the left microphone array signals and multiplying the time-dependent and frequency-dependent masks by the respective left front and rear microphone signal vectors to obtain left front and rear pointing beam signals.

The right microphone array signals may include at least a right front microphone signal vector and a right rear microphone signal vector. Generating the pair of directional signals from the right microphone array signals may include computing a right cardioid signal pair from the right front and rear microphone signal vectors. It may further include computing real-valued time-dependent and frequency-dependent masks based on the right cardioid signal pair and the right microphone array signals and multiplying the time-dependent and frequency-dependent masks by the respective right front and rear microphone signal vectors to obtain right front and rear pointing beam signals.

Suppressing diffuse signal components from the pairs of directional signals may include applying noise reduction to the pairs of directional signals using a common mask to suppress uncorrelated signal components.

Yet one or more additional embodiments of the present disclosure relate to a method for enhancing directional sound from an audio source external to a headset. The headset may include a left headphone having a left microphone array and a right headphone having a right microphone array. Each microphone array may include at least a front microphone and a rear microphone. For each microphone array, the method may include receiving microphone array signals corresponding to the external audio source. The microphone array signals may include at least a front microphone signal vector corresponding to the front microphone and a rear microphone signal vector corresponding to the rear microphone. The method may further include computing a forward-pointing beam signal and rearward-pointing beam signal from the front and rear microphone signal vectors and applying a noise reduction mask to the forward-pointing and rearward-pointing beam signals to suppress uncorrelated signal components and obtain a noise-reduced forward-pointing beam signal and a noise-reduced rearward-pointing beam signal. The method may also include applying a front head-related transfer function (HRTF) pair to the noise-reduced forward-pointing beam signal to obtain a front direct HRTF output signal and a front indirect HRTF output signal and applying a rear HRTF pair to the noise-reduced rearward-pointing beam signal to obtain a rear direct HRTF output signal and a rear indirect HRTF output signal. Further, the method may include adding the front direct HRTF output signal and the rear direct HRTF output signal to obtain at least a portion of a first headphone signal and adding the front indirect HRTF output signal and the rear indirect HRTF output signal to obtain at least a portion of a second headphone signal.

The method may further include adding the first headphone signal associated with the left microphone array to the second headphone signal associated with the right microphone array to form a left headphone output signal and adding the first headphone signal associated with the right microphone array to the second headphone signal associated with the left microphone array to form a right headphone output signal.

Computing the forward-pointing beam signal and rearward-pointing beam signal from the front and rear microphone signal vectors may include computing a cardioid signal pair from the front and rear microphone signal vectors. It may further include computing real-valued time-dependent and frequency-dependent masks based on the cardioid signal pair and the microphone array signals and multiplying the time-dependent and frequency-dependent masks by the respective front and rear microphone signal vectors to obtain the forward-pointing and rearward-pointing pointing beam signals.

The time-dependent and frequency-dependent masks may be computed as absolute values of normalized cross-spectral densities of the front and rear microphone signal vectors calculated by time averages. Moreover, the time-dependent and frequency-dependent masks may be further modified using non-linear mapping to narrow or widen the forward-pointing and rearward-pointing beam signals.

DETAILED DESCRIPTION

Figure 1:
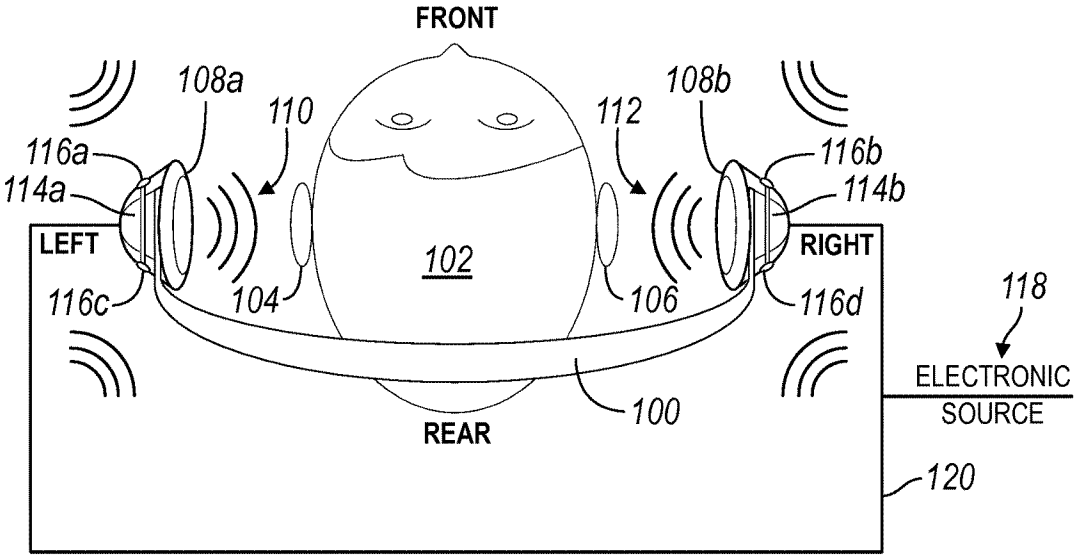
FIG. 1 is an environmental view showing an exemplary bionic hearing headset being worn by a person, in accordance with one or more embodiments of the present disclosure.

In the following detailed description, reference is made to the accompanying drawings, which form a part hereof. In the drawings, similar symbols typically identify similar components, unless context dictates otherwise. The partitioning of examples in function blocks, modules or units shown in the drawings is not to be construed as indicating that these function blocks, modules or units are necessarily implemented as physically separate units. Functional blocks, modules or units shown or described may be implemented as separate units, circuits, chips, functions, modules, or circuit elements. One or more functional blocks or units may also be implemented in a common circuit, chip, circuit element or unit.

The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

FIG. 1 depicts an environmental view representing an exemplary bionic hearing headset 100 being worn by a person 102 having a left ear 104 and a right ear 106, in accordance with one or more embodiments of the present disclosure. The headset 100 may include a pair of headphones 108, including a left headphone 108*a* and a right headphone 108*b*, which transmit sound waves 110, 112 to each respective ear 104, 106 of the person 102. Each headphone 108 may include a microphone array 114, such that a left microphone array 114*a* is disposed on a left side of a user's head and a right microphone array 114*b* is disposed on a right side of the user's head when the headset 100 is worn. The microphone arrays 114 may be integrated with their respective headphones 108. Further, each microphone array 114 may include a plurality of microphones 116, including at least a front microphone and a rear microphone. For instance, the left microphone array 114*a* may include at least a left front microphone 116*a* and a left rear microphone 116*c*, while the right microphone array 114*b* may include at least a right front microphone 116*b* and a right rear microphone 116*d*. The plurality of microphones 116 may be omnidirectional, though other types of directional microphones having different polar patters may be used such as unidirectional or bidirectional microphones.

The pair of headphones 108 may be well-sealed, noise-canceling around-the-ear headphones, over-the-ear headphones, in-ear type earphones, or the like. Accordingly, listeners may be well isolated and only audibly connected to the outside world through the microphones 116, while listening to content, such as music or speech, presented over the headphones 108 from an electronic audio source 118. Signal processing may be applied to microphone signals to preserve natural hearing of desired external sources, such as voices coming from certain directions, while suppressing unwanted, diffuse sounds, such as audience or crowd noise, internal airplane noise, traffic noise, or the like. According to one or more embodiments, directional hearing can be enhanced over natural hearing, for example, to discern distant audio sources from noise that wouldn't be heard normally. In this manner, the bionic hearing headset 100 may provide "superhuman hearing" or an "acoustic magnifier."

Figure 2:
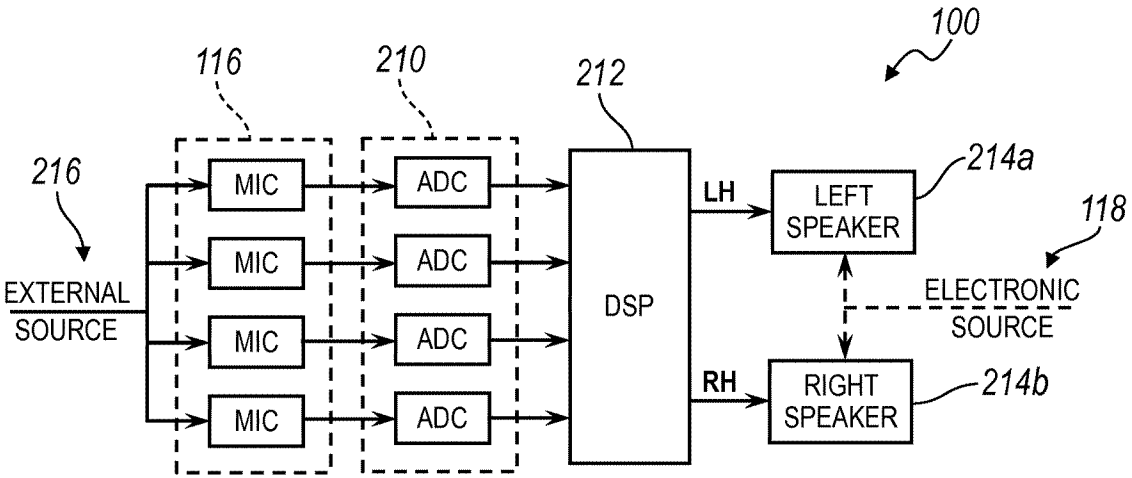
FIG. 2 is a simplified, exemplary schematic diagram of a bionic hearing headset, in accordance with one or more embodiments of the present disclosure.

FIG. 2 is a simplified, exemplary schematic diagram of the headset 100, in accordance with one or more embodiments of the present disclosure. As shown in FIG. 2, the headset 100 may include an analog-to-digital converter (ADC) 210 associated with each microphone 116 to convert analog audio signals to digital format. The headset may further include a digital signal processor (DSP) 212 for processing the digitized microphone signals. For ease of explanation, as used throughout the present disclosure, a generic reference to microphone signals or microphone array signals may refer to these signals in either analog or digital format, and in either time or frequency domain, unless otherwise specified.

Each headphone 108 may include a speaker 214 for generating the sound waves 110, 112 in response to incoming audio signals. For instance, the left headphone 108*a* may include a left speaker 214*a* for receiving a left headphone output signal LH from the DSP 212 and the right headphone 108*b* may include a right speaker 214*b* for receiving a right headphone output signal RH from the DSP 212. Accordingly, the headset 100 may further include a digital-to-analog converter DAC and/or speaker driver (not shown) associated with each speaker 214. The headphone speakers may 214 be further configured to receive audio signals from the electronic audio source 118, such as an audio playback device, mobile phone, or the like. The headset 100 may include a wire 120 (FIG. 1) and adaptor (not shown) connectable to the electronic audio source 118 for receiving audio signals therefrom. Additionally or alternatively, the headset 100 may receive audio signals from the electronic audio source 118 wirelessly. Though not illustrated, the audio signals from an electronic audio source may undergo their own signal processing prior to being delivered to the speakers 214. The headset 100 may be configured to transmit sound waves representing audio from an external source 216 and audio from the electronic audio source 118 simultaneously. Thus, the headset 100 may be generally useful for any users who wish to listen to music or a phone conversation while staying connected to the environment.

Figure 3:
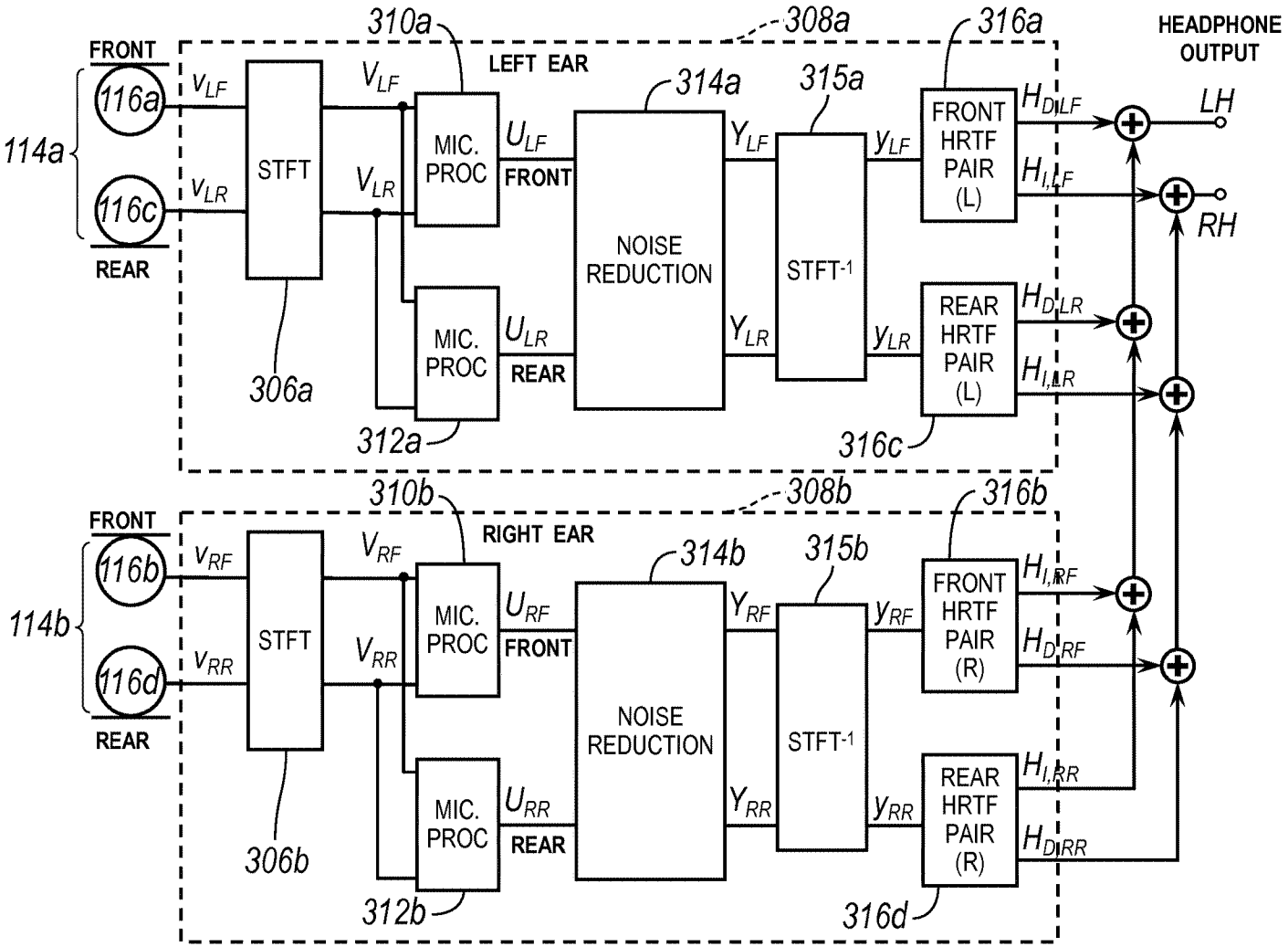
FIG. 3 is an exemplary signal processing block diagram, in accordance with one or more embodiments of the present disclosure.

FIG. 3 depicts an exemplary signal processing block diagram that may be implemented at least in part in the DSP 212 to process microphone array signals v. The ADCs 210 are not shown in FIG. 3 in order to emphasize the DSP signal processing blocks. Identical signal processing blocks are employed for each ear and pair-wise added at the output to form the final headphone signals. As shown, the signal processing block are divided in to identical signal processing sections 308, including a left microphone array signal processing section 308*a* and a right microphone array signal processing section 308*b*. For ease of explanation, the identical sections 308 of the signal processing algorithm applied to one of the microphone array signals will be described below generically (i.e., without a left or right designation) unless otherwise indicated. The generic notation for a reference to signals associated with a microphone array 114 generally includes either (A) an "F" or "+" designation in the signal identifiers' subscript to denote front or forward or (B) an "R" or "−" designation in the signal identifiers' subscript to denote rear or rearward. By contrast, a specific reference to signals associated with the left microphone array 114*a* includes an additional "L" designation in the signal identifiers' subscript to denote that it refers to the left ear location. Similarly, a specific reference to signals associated with the right microphone array 114*b* includes an additional "R" designation in the signal identifiers' subscript to denote that it refers to the right ear location.

Using this notation, a front microphone signal for any microphone array 114 may be labeled generically with $v_F$, while a specific reference to a left front microphone signal associated with the left microphone array 114*a* may be labeled with $v_{LF}$ and a specific reference to a right front microphone signal vector associated with the right microphone array 114*b* may be labeled with $v_{RF}$. Because many of the exemplary equations defined below are equally applicable to the signals received from either the left microphone array 114*a* or the right microphone array 114*b*, the generic reference notation is used to the extent applicable. However, the signals labeled in FIG. 3 use the specific reference notation as both the left-side and right-side signal processing sections 308*a,b* are shown.

The microphones 116 generate a time-domain signal stream. With reference to FIG. 3, the microphone array signals v include at least a front microphone signal vector $v_F$ and a rear microphone signal vector $v_R$. The algorithm operates in the frequency domain, using short-term Fourier transforms (STFTs) 306. A left STFT 306*a* forms left microphone array signals V in the frequency domain, while a right STFT 306*b* forms right microphone array signals V in the frequency domain. The frequency domain microphone array signals V include at least a front microphone signal vector $V_F$ and a rear microphone signal vector $V_R$. In a first signal processing stage, a front microphone processing block 310 (e.g., a left front microphone processing block 310*a* or a right front microphone processing block 310*b*) and a rear microphone processing block 312 (e.g., a left rear microphone processing block 312*a* or a right rear microphone processing block 312*b*) each receive both the front microphone signal vector $V_F$ and the rear microphone signal vector $V_R$. Each microphone processing block 310, 312 essentially functions as a beamformer for generating a forward-pointing directional signal $U_F$ and a rearward-pointing directional signal $U_R$ from the two microphones 116 in each microphone array 114. To generate directional signals for a microphone array 114 a pair of cardioid signals $X_{+/-}$ may first be computed using a known subtract-delay formula, as shown below in Equations 1 and 2:

$$X_+ = \text{delay}\{V_F\} - V_R \quad \text{(Eq. 1)}$$

$$X_- = \text{delay}\{V_R\} - V_F \quad \text{(Eq. 2)}$$

To obtain a cardioid response pattern, the delay value may be selected to match the travel time of an acoustic signal across the array axis. A DSP's delay may be quantized by the period of a single sample. At a sample rate of 48 kHz, for instance, the minimum delay is approximately 21 μs. The speed of sound in air varies with temperature. Using 70° F. as an example, the speed of sound in air is approximately 344 m/s. Thus, a sound wave travels about 7 mm in 21 μs. In this manner, a delay of 4-5 samples at a sample rate of 48 kHz may be used for a distance between microphones of around 28 mm to 35 mm. The shape of the cardioid response pattern for the beam-formed directional signals may be manipulated by changing the delay or the distance between microphones.

In certain embodiments, the cardioid signals $X_{+/-}$ may be used as the forward- and rearward-pointing directional signals $U_F$, $U_R$, respectively. According to one or more additional embodiments, instead of using the cardioid signals $X_{+/-}$ directly, real-valued time- and frequency-dependent masks $m_{+/-}$ may be applied. Applying a mask is a form of non-linear signal processing. According to one or more embodiments, the real-valued time- and frequency-dependent masks $m_{+/-}$ may be computed, for example, using Equation 3 below:

$$m_{+/-} = \left| \frac{\overline{V\ X^*_{+/-}}}{\overline{V^2}} \right|, \quad \text{(Eq. 3)}$$

with $\overline{V}(i)=(1-\alpha)\overline{V}(i-1)+\alpha V(i)$ denoting a recursively derived time average of V, $\alpha=0.01 \ldots 0.05$, i=time index, and where $X^*_{+/-}$ is the complex conjugate of $X_{+/-}$ As shown, the DSP 212 may compute the real-valued time- and frequency-dependent masks $m_{+/-}$ as absolute values of normalized cross-spectral densities calculated by time averages. In Equation 3, V can be either $V_F$ or $V_R$. The forward- and rearward-pointing directional signals $U_F$, $U_R$ may then be obtained by multiplying each microphone signal vector V element-wise with either $m_+$ for the forward-pointing beam or $m_-$ for the rearward-pointing beam:

$$U_F=V_F \cdot m_+ \quad \text{(Eq. 4)}$$

$$U_R=V_R \cdot m_- \quad \text{(Eq. 5)}$$

In this manner, the mask $m_{+/-}$, a number between 0 and 1, may act as a spatial filter to emphasize or deemphasize certain signals spatially. Additionally, using this method, the mask functions can be further modified using a nonlinear mapping F, as represented by Equation 6 below:

$$\tilde{m}=F\{m\} \quad \text{(Eq. 6)}$$

For example, if narrower beams are required than standard cardioids (e.g., super-directive beamforming), the function may further attenuate low values of m indicative of a low correlation between the original microphone signal V and the difference signal X. A "binary mask" may be employed in an extreme case. The binary mask may be represented as a step function that sets all values below a threshold to zero. Manipulating the mask function to narrow the beam may add distortion, whereas widening the beam can reduce distortion.

A subsequent noise reduction block 314 (e.g., a left noise reduction block 314*a* or a right noise reduction block 314*b*) in FIG. 3 may apply a second, common mask $m_{NR}$ to the resulting forward- and rearward-pointing directional signals $U_F$, $U_R$, in order to suppress uncorrelated signal components indicative of diffuse (i.e., not directional) sounds. The common, noise-reduction mask $m_{NR}$ may be calculated according to Equation 7 shown below:

$$m_{NR} = \left| \frac{\overline{U_F U_R^*}}{\sqrt{\overline{U_F^2}\ \overline{U_R^2}}} \right| \quad \text{(Eq. 7)}$$

For diffuse sounds, the value of the common mask $m_{NR}$ may be closer to zero. For discrete sounds, the value of the common mask $m_{NR}$ may be closer to one. Once obtained, the common mask $m_{NR}$ can then be applied to produce beamformed and noise-reduced directional signals, including a noise-reduced forward-pointing beam signal $Y_F$ and a noise-reduced rearward-pointing beam signal $Y_R$, as shown in Equations 8 and 9:

$$Y_F=U_F \cdot m_{NR} \quad \text{(Eq. 8)}$$

$$Y_R=U_R \cdot m_{NR} \quad \text{(Eq. 9)}$$

The resulting noise-reduced forward-pointing beam signals $Y_F$ and noise-reduced rearward-pointing beam signals $Y_R$ for both the left and right microphone arrays 114*a,b* may then be converted back to the time domain using inverse STFTs 315, including a left inverse STFT 315*a* and a right STFT 315*b*. The inverse STFT 315 produces forward-pointing beam signals $y_F$ and rearward-pointing beam signals $y_R$ in the time domain. The time domain beam signals may then be spatialized using parametric models of head-related transfer functions pairs 316. A head-related transfer function (HRTF) is a response that characterizes how an ear receives a sound from a point in space. A pair of HRTFs for two ears can be used to synthesize a binaural sound that seems to come from a particular point in space. As an example, parametric models of the left ear HRTFs for −45° (front) and −135° (rear) and the right ear HRTFs for +45° (front) and +135° (rear) may be employed.

Each HRTF pair 316 may include a direct HRTF and an indirect HRTF. With specific reference to the left microphone array signal processing section 308*a* shown in FIG. 3, a left front HRTF pair 316*a* may be applied to a left noise-reduced forward-pointing beam signal $y_{LF}$ to obtain a left front direct HRTF output signal $H_{D,LF}$ and a left front indirect HRTF output signal $H_{I,LF}$. Likewise, a left rear HRTF pair 316*c* may be applied to a left noise-reduced rearward-pointing beam signal $y_{LR}$ to obtain a left rear direct HRTF output signal $H_{D,LR}$ and a left rear indirect HRTF output signal $H_{I,LR}$. The left front direct HRTF output signal $H_{D,LF}$ and the left rear direct HRTF output signal $H_{D,LR}$ may be added to obtain at least a first portion of a left headphone output signal LH. Meanwhile, the left front indirect HRTF output signal $H_{I,LF}$ and the left rear indirect HRTF output signal $H_{I,LR}$ may be added to obtain at least a first portion of a right headphone output signal RH.

With specific reference to the right microphone array signal processing section 308*b*, a right front HRTF pair 316*b* may be applied to a right noise-reduced forward-pointing beam signal $y_{RF}$ to obtain a right front direct HRTF output signal $H_{D,RF}$ and a right front indirect HRTF output signal $H_{I,RF}$. Likewise, a right rear HRTF pair 316*d* may be applied to a right noise-reduced rearward-pointing beam signal $y_{RR}$ to obtain a right rear direct HRTF output signal $H_{D,RR}$ and a right rear indirect HRTF output signal $H_{I,RR}$. The right front direct HRTF output signal $H_{D,RF}$ and the right rear direct HRTF output signal $H_{D,RR}$ may be added to obtain at least a second portion of the right headphone output signal RH. Meanwhile, the right front indirect HRTF output signal $H_{I,RF}$ and the right rear indirect HRTF output signal $H_{I,RR}$ may be added to obtain at least a second portion of the left headphone output signal LH.

Collectively, the final left and right headphone output signals LH, RH sent the respective left and right headphone speakers 214*a,b* may be represented using Equations 10 and 11 below:

$$LH=H_{D,LF}+H_{D,LR}+H_{I,RF}+H_{I,RR} \quad \text{(Eq. 10)}$$

$$RH=H_{D,RF}+H_{D,RR}+H_{I,LF}+H_{I,LR} \quad \text{(Eq. 11)}$$

Figure 4:
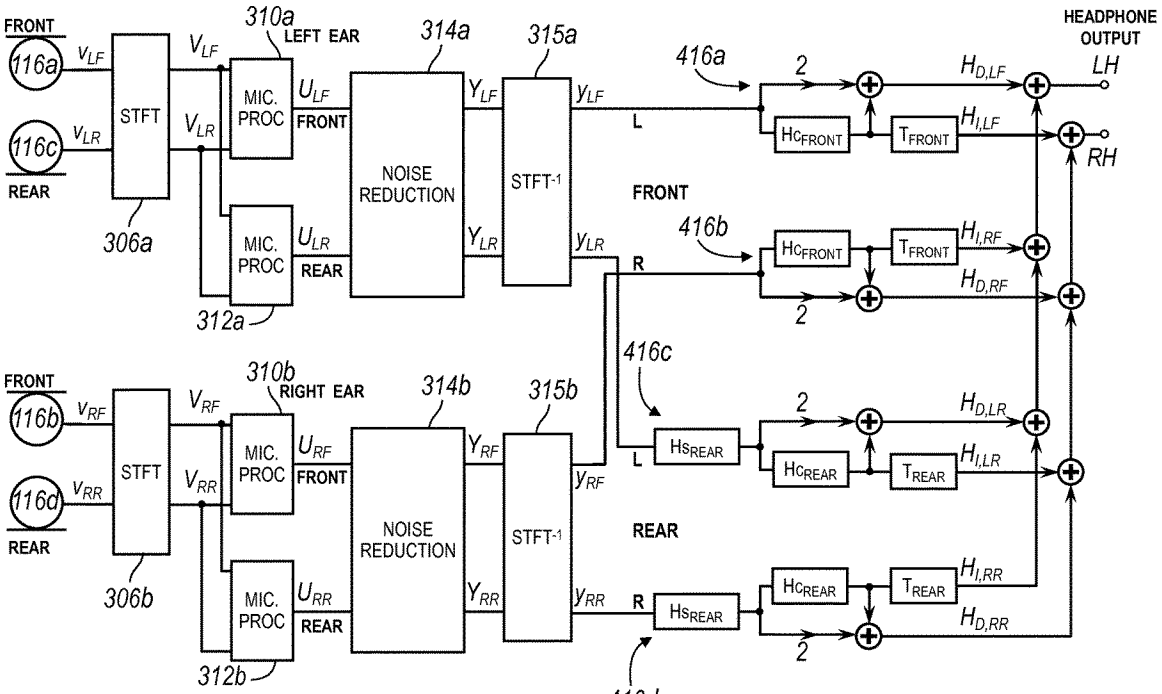
FIG. 4 is another exemplary signal processing block diagram, in accordance with one or more embodiments of the present disclosure.

FIG. 4 shows an exemplary signal processing application that employs HRTF pairs 416*a-d* in accordance with the parametric models that were disclosed in U.S. Patent Appl. Publ. No. 2013/0243200 A1, published Sep. 19, 2013, which is incorporated herein by reference. As shown, each HRTF pair 416*a-d* may include one or more sum filters (e.g., "$Hs_{rear}$"), cross filters (e.g., "$Hc_{front}$," "$Hc_{rear}$," etc.), or interaural delay filters (e.g., "$T_{front}$," "$T_{rear}$," etc.) to transform the directional signals $y_{LF}$, $y_{LR}$, $y_{RF}$, $y_{RR}$ into the respective direct and indirect HRTF output signals.

Figure 5:
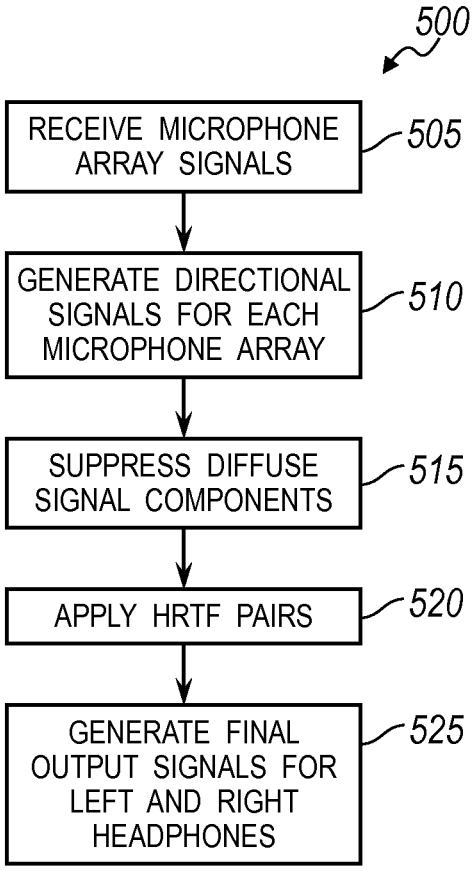
FIG. 5 is a simplified, exemplary process flow diagram of a microphone array signal processing method, in accordance with one or more embodiments of the present disclosure.

FIG. 5 is a simplified process flow diagram of a microphone array signal processing method 500, in accordance with one or more embodiments of the present disclosure. At step 505, the headset 100 may receive the microphone arrays signals v. More particularly, the DSP 212 may receive the left microphone array signals $v_{LF}$, $v_{LR}$ and the right microphone array signals $v_{RF}$, $v_{RR}$ and transform the signals to the frequency domain. From the microphone arrays signals, the DSP 212 may then generate a pair of beam-formed directional signals $U_F$, $U_R$ for each microphone array 114, as provided at step 510. At step 515, the DSP 212 may perform noise reduction to suppress diffuse sounds by applying a common mask $m_{NR}$. The resultant noise-reduced directional signals Y may be transformed back to the frequency domain (not shown). Next, HRTF pairs 316 may be applied to respective noise-reduced directional signals y to transform the audio signals into binaural format, as provided at step 520. In step 525, the final left and right headphone output signals LH, RH may be generated by pair-wise adding the signal outputs from the respective left microphone array and right microphone array signal processing sections 308*a,b*, as described above with respect to FIG. 3.

Figure 6:
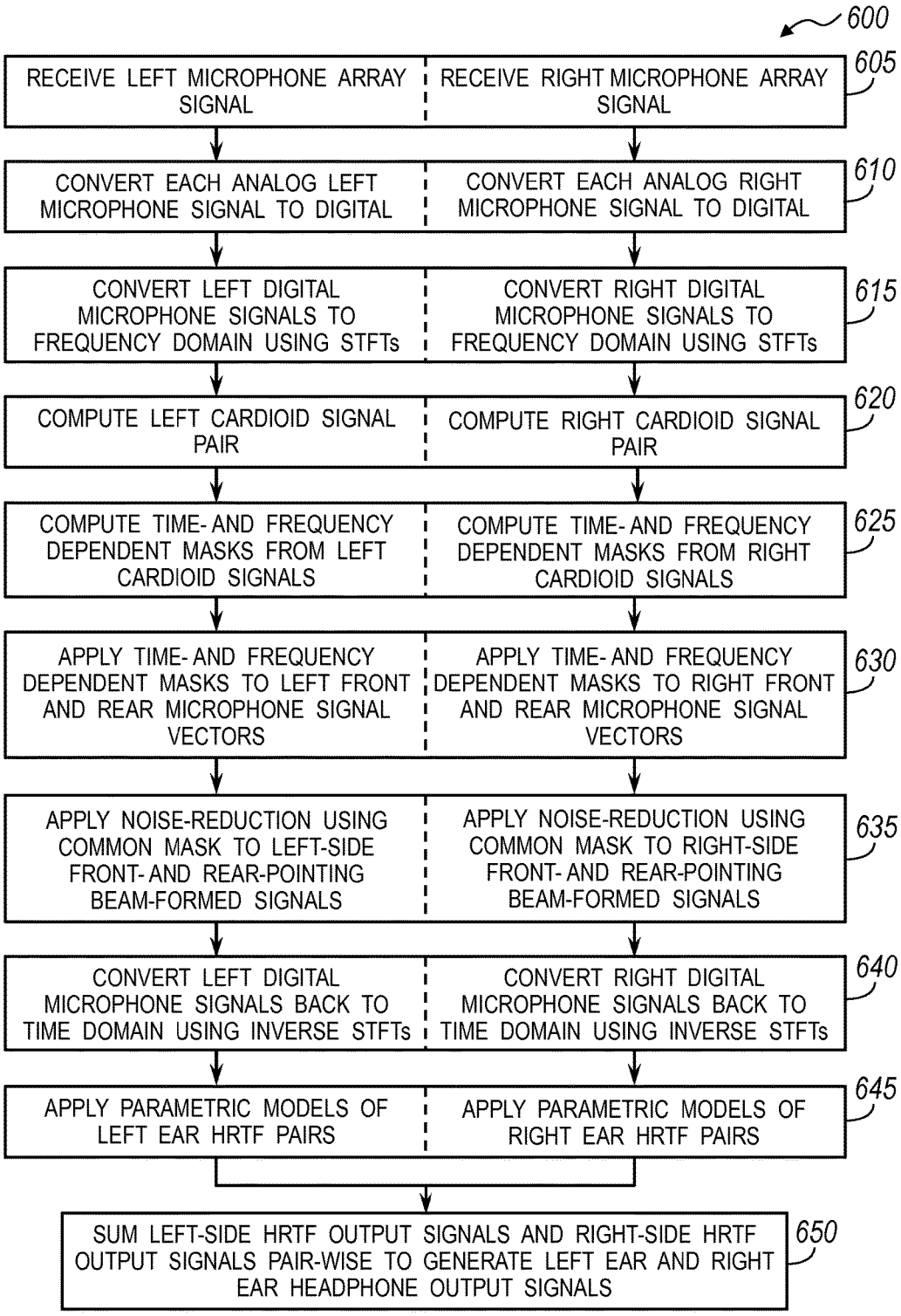
FIG. 6 is another simplified, exemplary process flow diagram of a microphone array signal processing method, in accordance with one or more embodiments of the present disclosure.

FIG. 6 is a more detailed, exemplary process flow diagram of a microphone array signal processing method 600, in accordance with one or more embodiments of the present disclosure. As described above with respect to FIG. 3, identical steps may be employed in processing both the left microphone array signals and the right microphone array signals. At step 605, the headset 100 may receive left microphone array signals $v_{LF}$, $v_{LR}$ and right microphone array signals $v_{RF}$, $v_{RR}$. The left microphone array signals $v_{LF}$, $v_{LR}$ may be representative of audio received from an external source 216 at the left front and rear microphones 116*a,c*. Likewise, the right microphone array signals $v_{RF}$, $v_{RR}$ may be representative of audio received from an external source 216 at the right front and rearmicrophones 116*b,d*. Each incoming microphone signal may be converted from analog format to digital format, as provided at step 610. Further, at step 615, the digitized left and right microphone array signals may be converted to the frequency domain, for example, using short-term Fourier transforms (STFTs) 306. The left front and rear microphone signal vectors $V_{LF}$, $V_{LR}$ and right front and rear microphone signal vectors $V_{RF}$, $V_{RR}$, respectively, can be obtained as a result of the transformation to the frequency domain.

At step 620, the DSP 212 may compute a pair of cardioid signals $X_{+/-}$ for each of the left front and rear microphone signal vectors $V_{LF}$, $V_{LR}$ and the right front and rear microphone signal vectors $V_{RF}$, $V_{RR}$. The cardioid signals $X_{+/-}$ may be computed using a subtract-delay beamformer, as indicated in Equations 1 and 2. Time- and frequency-dependent masks $m_{+/-}$ may then be computed for each pair of cardioid signals $X_{+/-}$, as provided in step 625. For example, the DSP 212 may compute time- and frequency-dependent masks $m_{+/-}$ using the left cardioid signals and left microphone signal vectors, as shown by Equation 3. The DSP 212 may also compute separate time- and frequency-dependent masks $m_{+/-}$ using the right cardioid signals and right microphone signal vectors. The time- and frequency-dependent masks $m_{+/-}$ may then be applied to their respective microphone signal vectors V to produce left-side front- and rear-pointing beam signals $U_{LF}$, $U_{LR}$ and right-side front- and rear-pointing beam signals $U_{RF}$, $U_{RR}$, using Equations 4 and 5, as demonstrated in step 630. The beam-formed signals may undergo noise reduction at step 635 to suppress uncorrelated signal components. To this end, a common mask $m_{NR}$ may be applied to the left-side front- and rear-pointing beam signals $U_{LF}$, $U_{LR}$ and right-side front- and rear-pointing beam signals $U_{RF}$, $U_{RR}$ using Equations 8 and 9. The common mask $m_{NR}$ may suppress diffuse sounds, thereby emphasizing directional sounds, and may be calculated as described above with respect to Equation 7.

At step 640, the resulting noise-reduced, beam signals Y may be transformed back to the time domain using inverse STFTs 315. The resulting time domain beam signals y may then be converted to binaural format using parametric models of HRTFs pairs 316, at step 645. For instance, the DSP 212 may apply parametric models of left ear HRTF pairs 316*a,c* to spatialize the noise-reduced left-side front- and rear-pointing beam signals $y_{LF}$, $y_{LR}$ for the left microphone array 114*a*. Similarly, the DSP 212 may apply parametric models of right ear HRTF pairs 316*b,d* to spatialize the noise-reduced right-side front- and rear-pointing beam signals $y_{RF}$, $y_{RR}$ for the right microphone array 114*b*. At step 650, the various left-side HRTF output signals and right-side HRTF output signals may then be pair-wise added, as described above with respect to Equations 10 and 11, to generate the respective left and right headphone output signals LH, RH.

While exemplary embodiments are described above, it is not intended that these embodiments describe all possible forms of the invention. Rather, the words used in the specification are words of description rather than limitation, and it is understood that various changes may be made without departing from the spirit and scope of the subject matter presented herein. Additionally, the features of various implementing embodiments may be combined to form further embodiments of the present disclosure.

What is claimed is:

1. A headset comprising:

a pair of headphones including a left headphone having a left speaker and a right headphone having a right speaker;

a pair of microphone arrays including a left microphone array integrated with the left headphone and a right microphone array integrated with the right headphone, each of the pair of microphone arrays including at least a front-located microphone and a rear-located microphone for receiving external audio from an external source; and a digital signal processor configured to receive left and right microphone array signals associated with the external audio, each microphone array signal including a front microphone signal vector generated by the front-located microphone and a rear microphone signal vector generated by the rear-located microphone, the digital signal processor being further configured to:

generate a pair of front and rear directional signals from each of the left and right microphone array signals;

suppress diffuse sounds from the pairs of directional signals;

apply parametric models of head-related transfer function (HRTF) pairs to each pair of directional signals to obtain a left front direct HRTF output signal, a left front indirect HRTF output signal, a left rear direct HRTF output signal, a left rear indirect HRTF output signal, a right front direct HRTF output signal, a right front indirect HRTF output signal, a right rear direct HRTF output signal, and a right rear indirect HRTF output signal;

add the left front direct HRTF output signal, the left rear direct HRTF output signal, the right front indirect HRTF output signal and the right rear indirect HRTF output signal to generate a left headphone output signal; and add the right front direct HRTF output signal, the right rear direct HRTF output signal, the left front indirect HRTF output signal and the left rear indirect HRTF output signal to generate a right headphone output signal.

2. The headset of claim 1, wherein the pair of headphones are further configured to playback audio content from an electronic audio source.

3. The headset of claim 1, wherein each pair of directional signals includes front and rear pointing beam signals.

4. The headset of claim 1, wherein the left microphone array signals include at least a left front microphone signal vector and a left rear microphone signal vector.

5. The headset of claim 4, wherein the digital signal processor configured to generate the pair of directional signals from the left microphone array signals includes the digital signal processor being configured to:

compute a left cardioid signal pair from the left front and rear microphone signal vectors;

compute real-valued time-dependent and frequency-dependent masks based on the left cardioid signal pair and the left microphone array signals; and multiply the time-dependent and frequency-dependent masks by the respective left front and rear microphone signal vectors to obtain left front and rear pointing beam signals.

6. The headset of claim 1, wherein the right microphone array signals include at least a right front microphone signal vector and a right rear microphone signal vector.

7. The headset of claim 6, wherein the digital signal processor configured to generate the pair of directional signals from the right microphone array signals includes the digital signal processor being configured to:

compute a right cardioid signal pair from the right front and rear microphone signal vectors;

compute real-valued time-dependent and frequency-dependent masks based on the right cardioid signal pair and the right microphone array signals; and multiply the time-dependent and frequency-dependent masks by the respective right front and rear microphone signal vectors to obtain right front and rear pointing beam signals.

8. The headset of claim 1, wherein the digital signal processor configured to suppress diffuse sounds from the pairs of directional signals includes the digital signal processor being configured to:

apply noise reduction to the pairs of directional signals using a common mask to suppress uncorrelated signal components.

9. A method for enhancing directional sound from an audio source external to a headset, the headset including a left headphone having a left microphone array and a right headphone having a right microphone array, each of the left and right microphone arrays including at least a front-located microphone and a rear-located microphone, the method comprising:

receiving a pair of microphone array signals corresponding to the external audio source, the pair of microphone array signals including a left microphone array signal and a right microphone array signal, each microphone array signal including a front microphone signal vector generated by the front-located microphone and a rear microphone signal vector generated by the rear-located microphone;

generating a pair of directional signals from each of the pair of microphone array signals;

suppressing diffuse signal components from the pairs of directional signals;

applying parametric models of head-related transfer function (HRTF) pairs to each pair of directional signals to obtain a left front direct HRTF output signal, a left front indirect HRTF output signal, a left rear direct HRTF output signal, a left rear indirect HRTF output signal, a right front direct HRTF output signal, a right front indirect HRTF output signal, a right rear direct HRTF output signal, and a right rear indirect HRTF output signal;

adding the right front direct HRTF output signal, the right rear direct HRTF output signal, the left front indirect HRTF output signal and the left rear indirect HRTF output signal to generate a left headphone output signal; and adding the right front direct HRTF output signal, the right rear direct HRTF output signal, the left front indirect HRTF output signal and the left rear indirect HRTF output signal to generate a right headphone output signal.

10. The method of claim 9, wherein the left microphone array signals include at least a left front microphone signal vector and a left rear microphone signal vector.

11. The method of claim 10, wherein generating the pair of directional signals from the left microphone array signals comprises:

computing a left cardioid signal pair from the left front and rear microphone signal vectors;

computing real-valued time-dependent and frequency-dependent masks based on the left cardioid signal pair and the left microphone array signals; and multiplying the time-dependent and frequency-dependent masks by the respective left front and rear microphone signal vectors to obtain left front and rear pointing beam signals.

12. The method of claim 9, wherein the right microphone array signals include at least a right front microphone signal vector and a right rear microphone signal vector.

13. The method of claim 12, wherein generating the pair of directional signals from the right microphone array signals comprises:

computing a right cardioid signal pair from the right front and rear microphone signal vectors;

computing real-valued time-dependent and frequency-dependent masks based on the right cardioid signal pair and the right microphone array signals; and multiplying the time-dependent and frequency-dependent masks by the respective right front and rear microphone signal vectors to obtain right front and rear pointing beam signals.

14. The method of claim 9, wherein suppressing diffuse signal components from the pairs of directional signals comprises:

applying noise reduction to the pairs of directional signals using a common mask to suppress uncorrelated signal components.

15. The method of claim 9, wherein each pair of directional signals includes front and rear pointing beam signals.

16. A method for enhancing directional sound from an audio source external to a headset, the headset including a left headphone having a left microphone array and a right headphone having a right microphone array, each microphone array including at least a front-located microphone and a rear-located microphone, for each microphone array the method comprising:

receiving microphone array signals corresponding to the external audio source, the microphone array signals including at least a front microphone signal vector corresponding to the front-located microphone and a rear microphone signal vector corresponding to the rear-located microphone;

computing a forward-pointing beam signal and rearward-pointing beam signal from the front and rear microphone signal vectors;

applying a noise reduction mask to the forward-pointing and rearward-pointing beam signals to suppress uncorrelated signal components and obtain a noise-reduced forward-pointing beam signal and a noise-reduced rearward-pointing beam signal;

applying a front head-related transfer function (HRTF) pair to the noise-reduced forward-pointing beam signal to obtain a front direct HRTF output signal and a front indirect HRTF output signal;

applying a rear HRTF pair to the noise-reduced rearward-pointing beam signal to obtain a rear direct HRTF output signal and a rear indirect HRTF output signal;

adding the front direct HRTF output signal and the rear direct HRTF output signal to obtain at least a portion of a first headphone signal; and adding the front indirect HRTF output signal and the rear indirect HRTF output signal to obtain at least a portion of a second headphone signal.

17. The method of claim 16, further comprising:

adding the first headphone signal associated with the left microphone array to the second headphone signal associated with the right microphone array to form a left headphone output signal; and adding the first headphone signal associated with the right microphone array to the second headphone signal associated with the left microphone array to form a right headphone output signal.

18. The method of claim 16, wherein computing the forward-pointing beam signal and rearward-pointing beam signal from the front and rear microphone signal vectors comprises:

computing a cardioid signal pair from the front and rear microphone signal vectors;

computing real-valued time-dependent and frequency-dependent masks based on the cardioid signal pair and the microphone array signals; and multiplying the time-dependent and frequency-dependent masks by the respective front and rear microphone signal vectors to obtain the forward-pointing and rearward-pointing pointing beam signals.

19. The method of claim 18, wherein the time-dependent and frequency-dependent masks are computed as absolute values of normalized cross-spectral densities of the front and rear microphone signal vectors calculated by time averages.

20. The method of claim 18, wherein the time-dependent and frequency-dependent masks are further modified using non-linear mapping to narrow or widen the forward-pointing and rearward-pointing beam signals.

* * * * *